United States Patent [19]

Volfson

[11] 4,399,855

[45] Aug. 23, 1983

[54] ROLL TYPE CLOSURE ASSEMBLY FOR A WINDOW

[75] Inventor: Boris Volfson, Middleton, Wis.

[73] Assignee: Graber Industries, Inc., Middleton, Wis.

[21] Appl. No.: 346,177

[22] Filed: Feb. 5, 1982

[51] Int. Cl.[3] ..... E06B 9/08

[52] U.S. Cl. ..... 160/23 R; 160/41; 160/271; 160/290 R

[58] Field of Search ..... 160/23 R, 41, 267–273, 160/290, 368 R, 380, 392, 395, 371

[56] References Cited

U.S. PATENT DOCUMENTS

| | | | |
|---|---|---|---|
| 1,102,094 | 6/1914 | Smith . | |
| 2,316,027 | 4/1943 | Swormstedt . | |
| 3,379,237 | 4/1968 | Warthington | 160/371 |
| 4,220,189 | 9/1980 | Marquez . | |
| 4,258,517 | 3/1981 | Hammond . | |
| 4,282,919 | 8/1981 | Teno . | |
| 4,357,978 | 11/1982 | Keller et al. | 160/41 |

*Primary Examiner*—Peter M. Caun

*Attorney, Agent, or Firm*—Vernon J. Pillote

[57] ABSTRACT

A roll type closure assembly for a window opening utilizing a roller shade mounted by brackets in the window opening. Side edge guides are provided which include a channel portion for receiving the side edges of the window shade, a mounting flange portion and a connecting portion between the mounting flange portion and the channel portion. A flex line is provided in the connecting portion to allow the mounting flange portion and the channel portion to be moved relative to each other between a first position extending generally perpendicular to a plane bisecting the channel portion for mounting on the window casing inside the window opening and a second position extending generally parallel to a plane bisecting the channel portion for mounting on the window casing outside the window opening. A U-shaped roller housing is provided for enclosing the roller and is mounted by end caps on the roller mounting brackets to provide a seal between the upper portion of the window shade and the top of the window casing.

19 Claims, 13 Drawing Figures

Fig. 1.
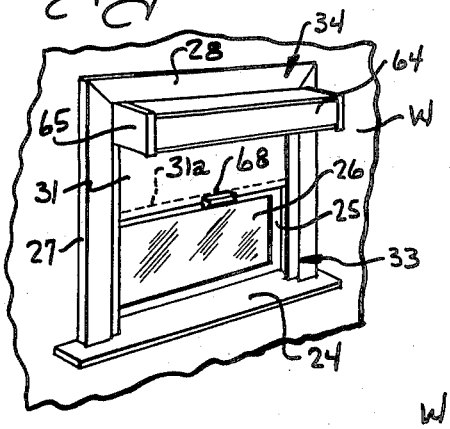
Fig. 3.
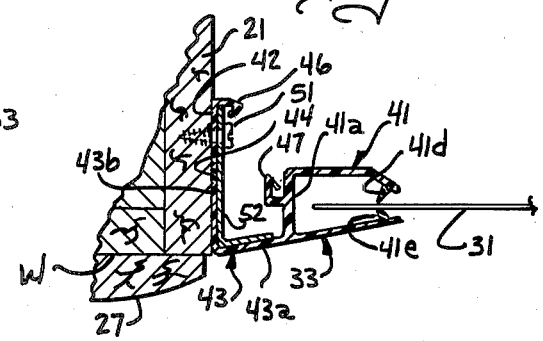
Fig. 2.
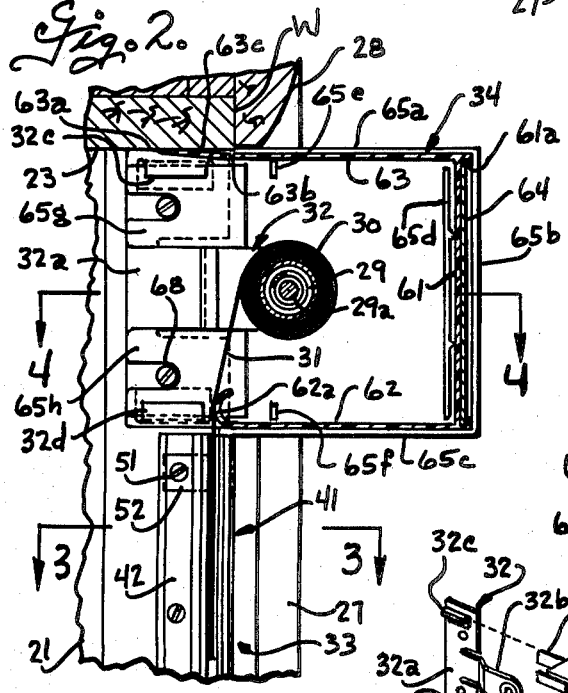
Fig. 4.
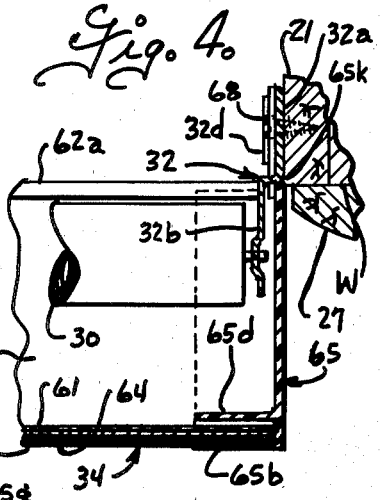
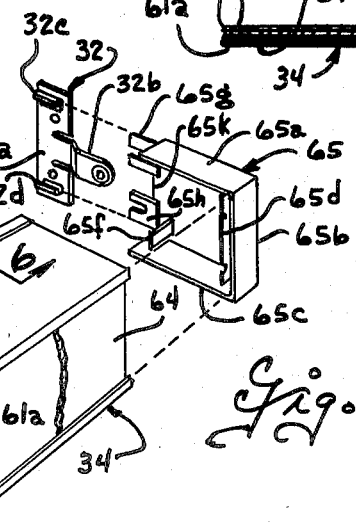
Fig. 5.
Fig. 6.
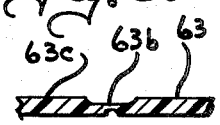

Fig. 7.
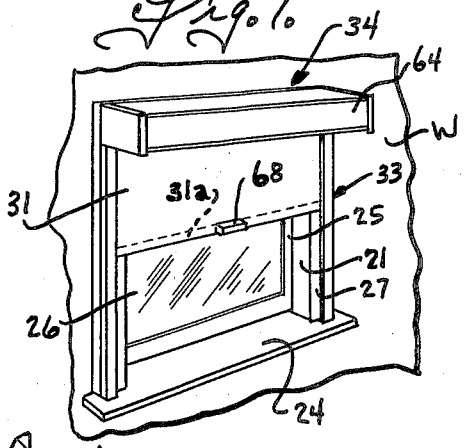
Fig. 9.
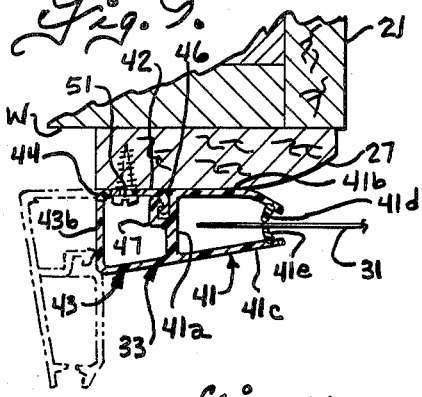
Fig. 8.
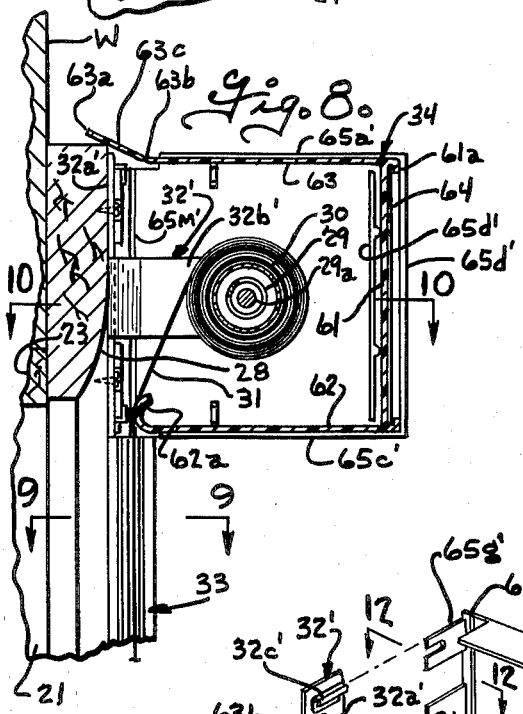
Fig. 10
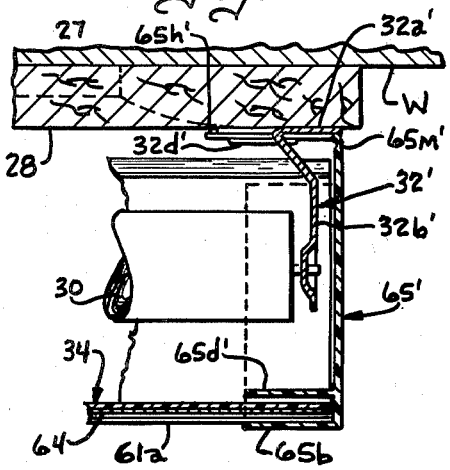
Fig. 12.
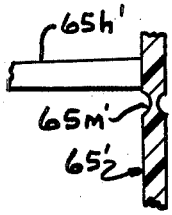
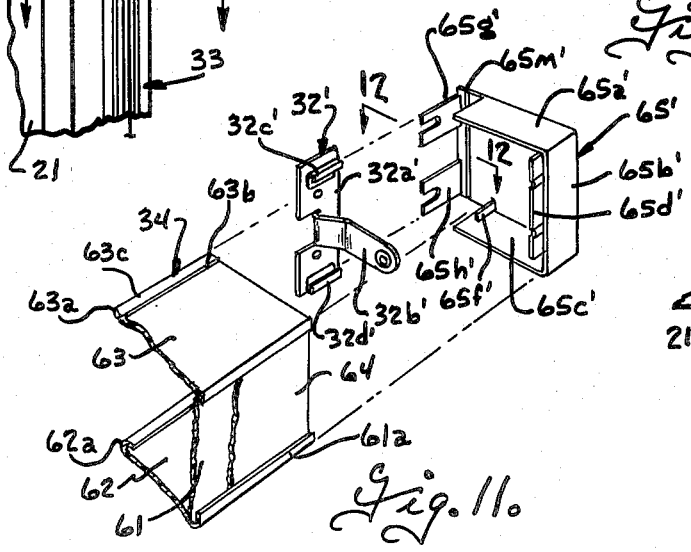
Fig. 11.
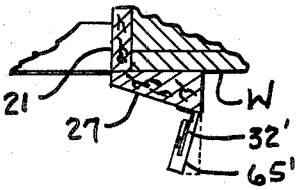
Fig. 13.

ROLL TYPE CLOSURE ASSEMBLY FOR A WINDOW

BACKGROUND OF THE INVENTION

It is well known that heat losses through windows can be reduced through the use of roll type window shades, and that the heat losses are further reduced when the shade is sealed along its edges. It has heretofore been proposed to utilize side edge guides mounted on the window frame which slidably receive the side edges of the shade and provide a seal between the side edges of the shade and the window frame. However, in some installations it is desired to mount the shade on the window frame inside the window opening while in others it is desirable to mount the shade on the frame outside the window opening, and some problems are encountered in accommodating both inside and outside shade mountings. For example, in U.S. Pat. Nos. 4,220,189 and 4,258,517, there are disclosed side edge guides which are adapted to be adhesively secured to the window frame outside the window opening. However, the side edge guides disclosed in these patents requires additional mounting strips for attaching the side edge guides inside the window opening.

It has also heretofore been proposed to utilize a roller housing along the top of the window opening to provide a seal between the top of the shade material and the window frame. Some prior roller housings, for example as disclosed in U.S. Pat. Nos. 2,316,027 and 4,282,919, mount the shade roller on end caps attached to the housing. However, such roller housings require housing end caps that are sufficiently strong to withstand the weight and forces applied to the roller shade during use. Some other roller housings such as disclosed in U.S. Pat. No. 1,102,094, mount the ends of the roller on roller support brackets attached to the window casing and separately mount the roller housing on the window casing. This not only complicates the installation of the roller and housing, but also introduces some problem in proper positioning of the roller housing relative to the roller and window casing to achieve a suitable seal between the window shade and window casing.

SUMMARY OF THE INVENTION

The present invention relates to a roll type closure assembly for a window opening of the type where the closure assembly includes a roller shade, roller mounting brackets for mounting the roller shade on a window frame, and side edge guides mounted on the window frame for guiding and sealing side edge portions of the window shade.

It is an object of the present invention to provide a roll type closure assembly for a window opening in which the side edge guides are adapted for mounting on the window from either inside or outside the window opening.

In accordance with the foregoing object, the present invention provides side edge guides comprising a unitary extrusion including a lengthwise extending channel portion adapted to receive a side edge portion of the window shade, a lengthwise extending mounting flange portion, and a lengthwise extending connecting portion intermediate the mounting flange portion and the channel portion, and means providing a lengthwise extending flex line in the connecting portion to allow the mounting flange portion to be moved relative to the channel portion between a first position extending generally perpendicular to a plane bisecting the channel portion for mounting on the window frame inside the window opening and a second position extending generally parallel to a plane bisecting the channel portion for mounting on the window frame outside the window opening.

Another object of this invention is to provide a roll type closure assembly for a window opening having a roller housing for the roller shade and which roller housing is adapted to provide a seal between the top of the window shade and the window opening when mounted on the inside or the outside of a window casing.

In accordance with the foregoing object, the present invention provides a U-shaped roller housing including a front wall, a bottom wall extending rearwardly from the front wall and having a guide lip along its rear edge, and a top wall extending rearwardly from the front wall and having its rear edge spaced from the front wall a distance greater than the spacing of the guide lip from the front wall, and means providing a lengthwise extending flex line in the top wall inwardly of its rear edge to allow the rear edge portion of the top wall to flex relative to the remainder of the top wall between a position extending generally coplanar with the top wall housing and a position extending at an angle to the top wall of the housing, a pair of end caps for closing the ends of the housing, and means for mounting the end caps on the roller mounting brackets.

Another object of this invention is to provide an improved arrangement for mounting the shade roller and roller housing which simplifies installation and assures proper positioning of the roller housing relative to the shade roller.

In accordance with the foregoing object, the present invention provides a pair of roller mounting brackets each including a mounting plate portion adapted for mounting on a window frame and a roller support portion extending from the mounting plate portion, a housing of U-shaped cross section including a front wall and top and bottom walls extending rearwardly from the front wall, a pair of end caps for closing and supporting the ends of the housing and having mounting ears at the rear ends thereof, and retainer flanges on the mounting plate portions of the roller mounting brackets for slidably receiving the mounting ears on the end caps for supporting the end caps on the roller mounting brackets.

These, together with other objects, features and advantages of this invention will become apparent from the following detailed description and the drawings in which:

FIG. 1 is a perspective view showing a roll type closure assembly mounted on a window frame inside of the window opening;

FIG. 2 is a fragmentary vertical sectional view through the roll type closure assembly of FIG. 1 showing the parts on a larger scale;

FIG. 3 is a fragmentary horizontal sectional view taken on the plane 3—3 of FIG. 2 and illustrating a side edge guide on a larger scale than FIG. 2;

FIG. 4 is a fragmentary horizontal sectional view taken on the plane 4—4 of FIG. 2;

FIG. 5 is a fragmentary exploded perspective view illustrating the manner of assembly of the roller housing and end caps on the roller support bracket;

FIG. 6 is a fragmentary sectional view taken on the plane 6—6 of FIG. 5;

FIG. 7 is a perspective view illustrating the roll type closure assembly mounted on a window frame outside of the window opening;

FIG. 8 is a fragmentary vertical sectional view through the roll type closure assembly of FIG. 7 illustrating the parts on a larger scale;

FIG. 9 is a fragmentary horizontal sectional view taken on the plane 9—9 of FIG. 8 and illustrating the edge guides on a larger scale than FIG. 8;

FIG. 10 is a fragmentary horizontal sectional view taken on the plane 10—10 of FIG. 8;

FIG. 11 is a fragmentary exploded perspective view illustrating assembly of the roller housing and end caps on the roller mounting bracket;

FIG. 12 is a fragmentary sectional view through the housing end cap taken on the plane 12—12 of FIG. 11 and illustrating the parts on a larger scale than FIG. 11;

FIG. 13 is a fragmentary horizontal sectional view illustrating the roller mounting brackets and end caps mounted on a window frame having a beveled molding strip.

The roll type closure assembly of the present invention is adapted to be mounted on a window frame to provide a supplemental closure for the window opening which can be drawn to closed position to inhibit heat passage through the window opening, and which can be selectively opened to provide visibility and to allow light and solar heat to pass through the window. The windows in general include a window casing having spaced side casing members 21 at the sides of the window, a top casing member 23 at the top of the casing, and a sill 24 at the bottom of the casing. A window sash or sashes 25 which may be of the double hung, casement or even fixed type, and which include one or more panes of glass 26, are mounted in the window casing and provide the primary closure for the window opening. As is conventional, casing molding or trim strips 27 and 28 are provided on the window frame along the sides and top respectively and overlap the interior wall W around the window opening.

The roll type closure assembly in general includes a shade roller 30, a flexible panel 31 having one end portion secured to the shade roller and adapted to be rolled on and unrolled therefrom, and roller mounting brackets 32 for mounting the shade roller on the window casing. The closure assembly also includes side edge guides 33 for guiding edge portions of the flexible panel and to provide a sliding seal between the side edge portions of the panel and the window casing, and a roller housing 34 arranged to enclose the shade roller and to provide a seal between the flexible panel 31 and the window casing along the top of the window opening.

The side edge guides 33 are provided to form a sliding seal between the side edge portions of the flexible panel 31 and the window casing and, in accordance with the present invention, the side edge guides 33 are constructed and arranged so that they can be mounted on the window frame either inside the window opening on the side casing members 21 or the outside of the window opening on the casing molding trim strips 27. The side edge guides comprise a unitary extrusion that includes a lengthwise extending channel portion 41 adapted to receive a side edge portion of the flexible panel, a lengthwise extending mounting flange portion 42, and a lengthwise extending connection portion 43 intermediate the mounting flange portion and the channel portion, and a means 44 providing a lengthwise extending flex line in the connecting portion to allow the mounting flange portion and the channel portion to be moved relative to each other between a first position extending generally perpendicular to a plane bisecting the channel portion for mounting on the window frame inside the window opening as shown in FIG. 3, and a second position extending generally parallel to a plane bisecting the channel portion for mounting on the window frame outside the window opening, as shown in FIG. 9. As best shown in FIGS. 3 and 9, the channel portion has a generally U-shaped cross section and includes a web **41*a* and legs 41*b* and 41*c* extending from the web and terminating with their distal edges spaced apart. In the preferred embodiment illustrated, the connecting portion 43 has a generally L-shaped cross section and includes one leg 43*a* that is connected to the channel portion 41 and a second leg 43*b* that is connected by the flex line forming means 44 to the mounting flange portion 42. Leg 43*a* is preferably disposed generally flush with the leg 41*c* of the channel portion to provide a smooth face therewith and leg 43*b* of the connecting portion is disposed in a plane perpendicular to a plane bisecting the channel portion, to normally extend coplanar with the mounting flange portion 42 for mounting on the window casing inside the window opening, as shown in FIG. 3. The side edge guides also include a means for latching the mounting flange portion 42 in a second position extending generally parallel to the plane bisecting the channel portion, for mounting on the window frame outside the window opening, as shown in FIG. 9. This latch means includes a first latch 46 formed along the free edge of the mounting flange portion 42, and a second latch 47 formed on the channel portion 41. As best shown in FIGS. 3 and 9, the flex line 44 between the connecting portion 43 and the mounting flange portion 42 is located so that the mounting flange portion will extend generally coplanar with the leg 41*b* of the channel portion when the mounting flange portion is folded along the flex line 44 to extend generally parallel to a plane bisecting the channel portion. The latch 47 is formed on the web 41*a* of the channel portion at a location to engage the latch 46 when the mounting flange portion is disposed coplanar with the leg 41*b* of the channel portion, as shown in FIG. 9. In order to provide an improved sliding seal along the side edges of the flexible panel 31, resilient lips 41*d* and 41*e* are advantageously provided on the legs 41*b* and 41*c* of the channel portion respectively. As shown in the drawings, the resilient lips extend toward each other and preferably into a light wiping contact with the opposite sides of the flexible panel 31**. The lips preferably converge in a direction inwardly of the channel to aid in keeping the edge portion of the flexible panel in the channel.

The side edge guides 33 are formed of a synthetic resin material and the resilient lips **41*d* and 41*e* and the means 44 for forming a flex line are preferably formed of a more flexible plastic material than the remainder of the slide edge guides. The side edge guides may be formed by co-extruding a relatively rigid plastic material such as rigid polyvinylchloride in bands which form the channel portion 41, connecting portion 43, and mounting flange portion 42, and a more flexible plastic material such as flexible polyvinylchloride in bands to form the lips 41*d* and 41*e* and the flex line 44**. The method and apparatus for co-extruding related plastic materials of dissimilar properties for forming a composite extrusion are well known to those skilled in the art and detailed description of the method and apparatus for producing co-extrusions is deemed unnecessary.

The mounting flange portion of the side edge guides is attached to the window casing by fasteners such as nails or screws 51 at spaced locations along the mounting flange portion. The mounting flange portion is preferably provided with openings at spaced locations therealong for receiving the fasteners. When the side edge guides are mounted on the window casing inside the window opening as shown in FIG. 3, generally L-shaped brackets 52 are provided to rigidify the side edge guides and stabilize their position. As shown in FIG. 3, the brackets 52 have one leg that extends along the mounting flange portion 42 and along the leg 43*b* of the connecting portion to inhibit flexing along the flex line 44, and a second leg that extends along at least a portion of the leg 43*a* of the connecting portion, to stabilize the position of the channel portion in the window casing. The brackets are conveniently formed with an opening for receiving the mounting fasteners 51 so that they are mounted by the same fasteners used to mount the side edge guides on the window casing. When the side edge guides are mounted on the window casing outside the window opening, the mounting flange portions 42 of the side edge guides are attached as by the nail or screw fasteners 51 to the faces of the side trim strips 27 of the window casing, while the mounting flange portion extends generally perpendicular to a plane bisecting the channel portion, as shown in phantom in FIG. 9. After the mounting flange portions are properly secured to the side trim strips 27, the channel portion and connecting portion are folded relative to the mounting flange portion along the flex line 44 and latched by latches 46, 47 in the position shown in FIG. 9, with the mounting flange portion disposed parallel to a plane bisecting the channel portion.

The shade roller housing 34 is constructed and arranged to form a seal between the window casing and the shade along the top of the window opening. The shade roller housing is preferably formed of a synthetic resin material and may, for example be formed of polyvinylchloride. The roller housing has a generally U-shaped cross section and includes a front wall 61, a bottom wall 62 extending rearwardly from the front wall and having a guide lip 62*a* along its rear edge, and a top wall 63 extending rearwardly from the front wall and having its rear edge 63*a* spaced from the front wall a distance greater than the spacing of the guide lip 62*a* from the front wall. A lengthwise extending flex line 63*b* is formed in the top wall inwardly of its rear edge to allow a rear edge portion 63*c* of the top wall to flex relative to the remainder of the top wall between a position extending generally coplanar with the top wall of the housing, to seal against the inside of a window casing as shown in FIG. 2 and a position extending at an angle to the top wall of the housing to seal against the outer side of the window casing, as shown in FIG. 8. The front wall 61 is preferably provided with top and bottom flanges 61*a* at its outer side for receiving a housing trim panel 64 of cloth, paper, plastic or the like and which may, for example, be a section of the shade material 31 so that the housing is coordinated with the window shade.

End caps 65 are provided for closing the ends of the U-shaped housing and provision is made for mounting the end caps on the roller mounting brackets 32 to position the housing in proper relation to the window casing and to the flexible panel 31 to form a seal between the panel and the casing along the top of the window opening. The end caps are also preferably formed of a synthetic resin material and may, for example, be formed of polystyrene. The end caps 65 have flanges 65*a*, 65*b* and 65*c* arranged to extend along the outer sides of the top, front and bottom walls of the housing 34. A locating flange 65*d* is spaced inwardly from the flange 65*b* and arranged to engage the inner side of the front wall 61 of the housing to position and locate the front wall housing on the end caps. Upper and lower locating lugs 65*e* and 65*f* are also provided and arranged to engage the inside of the upper and lower walls of the housing respectively to locate the same in close relation to the top and bottom flanges 65*a* and 65*c* respectively.

The end caps 65 are constructed and arranged to support the roller housing 34 on the roller mounting bracket in a manner to provide a seal between the flexible panel 31 and the window casing along the top of the window shade. The roller support brackets are preferably formed of metal and each include a mounting plate portion 32*a* and a roller support portion 32*b* that extends from the mounting plate portion to engage and support the shade roller 30. The mounting plate portion has a vertical height substantially equal to the depth of the roller support housing 34 and the end caps are arranged to support the housing on the mounting plate portion with the top and bottom walls of the housing substantially coplanar with the top and bottom ends of the mounting plate portions of the mounting brackets. When the roll type closure assembly is mounted on the window casing inside the window opening as shown in the embodiment of FIGS. 1–6, the mounting plate portions 32*a* are secured as by fasteners such as screws 68 to the upright casing members 21 with the upper end of the mounting plate portions abutting the top casing member 23 as best shown in FIG. 2. The roller support portion 32*b* extends from the mounting plate portion and is offset inwardly from the inner face of the mounting plate portion to provide clearance for the roller support pintles on the shade roller. Upper and lower generally L-shaped end cap retainer flanges 32*c* and 32*d* are formed on the mounting plate portion and extend crosswise of the lengthwise dimension of the mounting plate portion at the inner side thereof for receiving upper and lower ears 65*g* and 65*h* formed on the rear ends of the end caps 65. The ears 65*g* and 65*h* are spaced apart a distance to straddle the roller support portion 32*b* of the mounting bracket and are dimensioned to be slidably received between the mounting plate portion and the respective end cap retainer flange 32*c* and 32*d*. As shown in FIG. 2, the retainer flanges 32*c* and 32*d* and ears 65*g* and 65*h* support the end caps on the mounting plate portion at a position such that the top wall 63 of the housing 34 is closely adjacent the underside of the top casing member 23 on the window casing and such that the rear edge portion 63*c* of the top wall forms a seal between the roller housing and the window casing. As best shown in FIG. 4, the ears 65*g* and 65*h* are offset slightly from the plane of the end caps 65 so that the rear edge 65*k* of the end cap defines a shoulder adapted to abut against an edge of the mounting plate portion 32*a* to locate the end cap and housing in a preset rear position. As shown in FIG. 2, the bottom wall 62 of the housing is dimensioned so that the lip 62*a* extends beyond the shoulder 65*k* at the rear edge of the end cap a distance substantially equal to the space in between a plane that bisects the channel portion 41 and the outer edge of the edge guide, so that the lip 62*a* is positioned substantially vertically above the channel to guide the shade material 31 from the roller 30 into the channel. The mounting ears 65*g* and 65*h* are preferably symmetrically positioned with respect to the horizontal center of the end caps so that the end caps at opposite ends of the housing can have the same configuration.

The roller mounting brackets and the end caps for the housing are modified slightly for mounting the roll type closure assembly on the casing molding or trim outside of the window opening, as shown in FIGS. 7–13, and like numerals followed by the postscript ′ are used to designate corresponding parts. The roller support brackets 32′ have a mounting plate portion 32*a′* and a roller support portion 32*b′* that extends generally perpendicular to the plane of the mounting plate portion. Upper and lower end cap retainer flanges 32*c′* and 32*d′* are provided on the mounting plate portion and arranged to receive ears 65*g′* and 65*h′* formed on the end caps 65′, and which ears extend generally perpendicular to the plane of the end caps at the rear edges thereof. For reasons discussed hereinafter, a flex line 65*m′* is formed in the end cap between the ears 65*g′* and 65*h′* and the body of the end cap to allow the end cap to be flexed slightly relative to the ears. The end caps 65′ are otherwise similar to those previously described in connection with FIGS. 1–6 and include flanges 65*a′*, 65*b′* and 65*c′* adapted to extend along the top, front and bottom of the housing 34, a retainer flange 65*d′* inwardly of the front flange 65*b′* and retainer lugs 65*e′* and 65*f′* to engage the top and bottom walls of the housing. As best shown in FIG. 8, the end caps support the housing with the lip 62*a* offset forwardly of the mounting plate portion of the roller support brackets a distance to guide the flexible panel from the roller into the side edge guides 34. As previously described, the rear edge 63*a* of the top wall 63 of the housing extends rearwardly from the front wall a distance greater than the spacing between the lip 62*a* and the front wall, and the rear edge portion 63*c* is arranged to flex along the flex line 63*b* to extend at an angle to the top wall as is required to engage and seal against the upper casing molding or trim strip 28 as shown in FIG. 8.

In FIGS. 7–10, the roller mounting brackets 32′ are shown mounted on the casing molding or trim at a location where the surface of the casing is substantially parallel to the interior wall W. However, the mounting brackets 32′ and end caps 65′ are also adapted for mounting at a location where the mounting surface is arched or inclined relative to the plane of the wall surface, for example, as shown in FIG. 13. As shown in that figure, the mounting plate portion 32*a′* of the mounting brackets can be attached to the inclined surface of the casing trim strip and the roller support portion 32*b′* then bent relative to the mounting plate portion so as to extend generally perpendicular to the surface of the wall. The end caps 65′ can be mounted on the mounting plate portions 32*a′* and the end caps thereafter flexed along the flex line 65*m′* to extend generally perpendicular to the plane of the wall, as shown in phantom in FIG. 13. Alternatively, wedges or shims can be used between the mounting plate portion and the inclined face of the trim molding to position the mounting plate portion and end caps generally perpendicular to the wall surface.

The shade roller 30 can be formed of wood, tubular fiber or metal and is provided a shade motor to assist rewinding of the shade on the roller. The shade motor can be of the type commonly used on roller shades, but omitting the clutch usually provided for releasably holding shade in a drawn condition. In general, the spring motor includes an elongated coil spring 29 which has one end anchored to the roller and the other end connected to a spear 29*a* that extends from one end of the roller and is non-rotatably received in one of the roller mounting brackets. A pin extends from the other end of the roller and is rotatably supported in the other of the mounting brackets. The flexible panel or shade 31 can be of various different materials which inhibit the passage of air therethrough and can be opaque or translucent. For high thermal insulation value, the shade material can be a multi-layer material including, for example, a metallic layer to reflect the relatively long infra red heat rays from winter heating unit back into the room; a white layer for reflecting solar heat in summer; a foam layer to reduce heat conduction through the fabric; and a decorative inner layer. The lower edge of the shade is hemmed to form slat receiving pocket that extends the full width of the shade and a shade stiffening slat 31*a* is inserted in one pocket and is preferably made the same width as the shade so that the ends of the slat receiving pocket and slat extend into the side edge guides. The lips 41*d* and 41*e* on the side edge guides are made sufficiently resilient to deform and allow the slat pocket and slat to pass along the side edge guides. However, the friction between the lips 41*d* and 41*e* and slat pocket and slat 31*a* tends to hold the shade in a desired drawn position and the tension on the shade motor is adjusted such that the shade can be raised or lowered only by manually pulling down or pushing up on the lower edge of the shade. A shade pull 68 is provided on the lower edge of the panel 31 to facilitate raising and lowering of the shade. If desired, a resilient sealing strip (not shown) can be provided along the lower edge of the shade to improve the seal between the lower edges of the shade and the window sill 24.

From the foregoing it is thought that the construction, installation and use of the roll type closure assembly will be readily understood. The side edge guides 33 can be mounted on the side casing members inside the window opening as shown in FIGS. 1–3, or on the casing trim strip or molding outside the window opening as shown in FIGS. 7–10, and the channels form a sliding seal between the shade 31 and the sides of the window casing. The roller 30 and the roller housing 34 can be mounted by brackets 32 and end caps 65 on the inside of the window opening as shown in FIGS. 1–5 with the housing arranged to form a seal between the window shade 31 and the casing. Alternatively, the shade roller 30 and housing 34 can be mounted by roller mounting brackets 32′ and end caps 65′ on the casing trim strip outside of the window opening with the roller housing 34 arranged to form a seal between the shade material and the casing trim strip along the top of the window opening.

The embodiments of the invention in which an exclusive property or privilege is claimed are defined as follows:

1. A roll type closure assembly for a window opening defined by a window frame, the closure assembly including a roller, a pair of roller mounting brackets for supporting the ends of the roller on a window frame, a flexible panel having one end portion attached to the roller and adapted to be rolled on and unrolled from the roller, a pair of side edge guides for guiding side edge portions of the flexible panel, each side edge guide comprising a unitary extrusion including a lengthwise extending channel portion adapted to receive a side edge portion of the flexible panel and a lengthwise extending mounting flange portion and a lengthwise extending connecting portion intermediate the mounting flange portion to the channel portion, means providing a lengthwise extending flex line in the connecting portion to allow the mounting flange portion and the channel portion to be moved relative to each other between a first position extending generally perpendicular to a plane bisecting the channel portion for mounting on the window frame inside of the window opening and a second position extending generally parallel to a plane bisecting the channel portion for mounting on the window frame outside the window opening.

2. A roll type closure assembly according to claim 1 including means for latching said mounting flange portion in one of said positions.

3. A roll type closure assembly according to claim 1 wherein said mounting flange portion is normally disposed in said first position, and means for latching said mounting flange portion in said second position.

4. A roll type closure assembly according to claim 1 wherein said connecting portion includes a wall portion disposed generally coplanar with said mounting flange portion when the latter is in said first position, and means for latching said mounting flange portion in said second position.

5. A roll type closure assembly according to claim 4 wherein said mounting flange portion in said second position thereof is disposed generally coplanar with one side of the channel portion.

6. A roll type closure assembly according to claim 1 wherein said unitary extrusion is formed of plastic material and said means providing said flex line comprises a band of plastic material that is relatively more flexible than the plastic material in the mounting flange portion and channel portion.

7. A roll type closure assembly according to claim 1 wherein said unitary extrusion is formed of plastic material, said channel portion having at least one panel engaging lip portion formed integrally with the channel portion at the open end thereof of a plastic material that is relatively more flexible than the plastic material in the channel portion.

8. A roll type closure assembly according to claim 1 wherein said unitary extrusion is formed of plastic material, said channel portion has a pair of panel engaging lip portions formed integrally therewith at opposite sides of the open end thereof of a plastic material that is relatively more flexible than the plastic material in the channel portion.

9. A roll type closure assembly according to claim 8 wherein said panel engaging lip portions converge relative to each other in a direction inwardly of the channel portion.

10. A roll type closure assembly according to claim 1 including a U-shaped housing including a front wall; a bottom wall extending rearwardly from the front wall and having a guide lip along its rear edge; and a top wall extending rearwardly from the front wall and having its rear edge spaced from the front wall a distance greater than the spacing of the guide lip from the front wall, means providing a lengthwise extending flex line in the top wall inwardly of its rear edge to allow a rear edge portion of the top wall to flex relative to the remainder of the top wall between a position extending generally coplanar with the top wall of the housing and a position extending at an angle to the top wall of the housing, a pair of end caps for closing the ends of the housing, and means for mounting the end caps on the roller mounting brackets.

11. A roll type closure assembly according to claim 10 wherein said roller mounting brackets each include a mounting plate portion adapted for mounting on a window frame and a roller support portion extending forwardly from the mounting plate portion, said means for mounting the end caps including ear means on the rear ends of the end caps and flange means on the mounting plate portions of the mounting brackets engageable with said ear means for supporting the end caps on the mounting brackets.

12. A roll type closure assembly according to claim 11 wherein said end caps each have means providing a flex line to allow flexing of the ear means relative to the remainder of the respective end cap along a line parallel to said front wall of the housing.

13. A roll type closure assembly according to claim 1 wherein said roller mounting brackets each include a mounting plate portion adapted for mounting on a window frame and a roller support portion extending forwardly from the mounting plate portion, a U-shaped housing including a front wall and top and bottom walls extending rearwardly from the front wall, a pair of end caps for closing the ends of the housing and each having ear means on the rear ends thereof, and flange means on the mounting plate portions of the mounting brackets engageable with said ear means for supporting the end caps on the mounting brackets.

14. A roll type closure assembly according to claim 13 wherein said end caps each have means providing a flex line to allow flexing of the ear means relative to the remainder of the respective end cap along a line parallel to said front wall of the housing.

15. A roll type closure assembly for a window opening defined by a window frame, the closure assembly including roller means, a pair of roller mounting brackets each including a mounting plate portion adapted for mounting on a window frame and a roller support portion extending forwardly from the mounting plate portion, a flexible panel having one end portion attached to the roller means and adapted to be rolled on and unrolled therefrom, a pair of side edge guides for guiding side edge portions of the flexible panel, means for mounting the side edge guides on a window frame, a U-shaped housing including a front wall; a bottom wall extending rearwardly from the front wall and having a guide lip along its rear edge; and a top wall extending rearwardly from the front wall and having its rear edge spaced from the front wall a distance greater than the spacing of the guide lip from the front wall, means providing a lengthwise extending flex line in the top wall inwardly of its rear edge to allow a rear edge portion of the top wall to flex relative to the remainder of the top wall between a position extending generally coplanar with the top wall of the housing and a position extending at an angle to the top wall of the housing, a pair of end caps for closing the ends of the housing, and means for mounting the end caps on the roller mounting brackets.

16. A roll type closure assembly according to claim 15 wherein said roller mounting brackets each include a mounting plate portion adapted for mounting on a window frame and a roller support portion extending forwardly from the mounting plate portion, said means for mounting the end caps including ear means on the rear ends of the end caps and flange means on the mounting plate portions of the mounting brackets engageable with said ear means for supporting the end caps on the mounting brackets.

17. A roll type closure assembly according to claim 16 wherein said end caps each have means providing a flex line to allow flexing of the ear means relative to the remainder of the respective end cap along a line parallel to said front wall of the housing.

18. A roll type closure assembly for a window opening defined by a window frame, the closure assembly including roller means, a pair of roller mounting brackets each including a mounting plate portion adapted for mounting on a window frame and a roller support portion extending forwardly from the mounting plate portion, a flexible panel having one end portion attached to the roller means and adapted to be rolled on and unrolled therefrom, a pair of side edge guides for guiding side edge portions of the flexible panel, means for mounting the side edge guides on a window frame, a housing of U-shaped cross section including a front wall and top and bottom walls extending rearwardly from the front wall, a pair of end caps for closing and supporting the ends of the housing and each having mounting ear means on the rear ends thereof, and retainer flange means on the mounting plate portions of the roller mounting brackets engageable with said mounting ear means for supporting the end caps on the roller mounting brackets.

19. A roll type closure assembly according to claim 18 wherein said end caps each have means providing a flex line to allow flexing of the ear means relative to the remainder of the respective end cap along a line parallel to said front wall of the housing.

* * * * *